US008777670B2

(12) United States Patent
Blakborn et al.

(10) Patent No.: US 8,777,670 B2
(45) Date of Patent: Jul. 15, 2014

(54) PLUG ADAPTER HAVING PLUG SIDE ENDS WITH DISSIMILAR MECHANICAL INTERFACE GEOMETRIES

(75) Inventors: Willem Blakborn, Inzell (DE); Martin Zebhauser, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 107 days.

(21) Appl. No.: 13/509,106

(22) PCT Filed: Sep. 23, 2010

(86) PCT No.: PCT/EP2010/005829

§ 371 (c)(1),
(2), (4) Date: Jul. 9, 2012

(87) PCT Pub. No.: WO2011/057691

PCT Pub. Date: May 19, 2011

(65) Prior Publication Data

US 2012/0270447 A1 Oct. 25, 2012

(30) Foreign Application Priority Data

Nov. 10, 2009 (DE) ..... 20 2009 015 286 U

(51) Int. Cl.
*H01R 33/00* (2006.01)

(52) U.S. Cl.
USPC ..... 439/638

(58) Field of Classification Search
USPC ..... 439/655, 638–639
See application file for complete search history.

(56) References Cited

U.S. PATENT DOCUMENTS

| | | | | |
|---|---|---|---|---|
| 4,906,200 | A | 3/1990 | Miyake | |
| 5,906,511 | A * | 5/1999 | Bozzer et al. | 439/579 |
| 7,306,484 | B1 | 12/2007 | Mahoney | |
| 7,878,833 | B2 * | 2/2011 | Chen et al. | 439/284 |
| 2004/0229508 | A1 * | 11/2004 | Miyazaki et al. | 439/607 |
| 2008/0242133 | A1 | 10/2008 | Herlitz | |
| 2009/0053938 | A1 * | 2/2009 | Borchardt | 439/676 |
| 2009/0104819 | A1 * | 4/2009 | Hermant et al. | 439/638 |

FOREIGN PATENT DOCUMENTS

| | | | |
|---|---|---|---|
| DE | 20 2005 009962 | U1 | 8/2005 |
| DE | 10 2006 018538 | A1 | 10/2007 |
| EP | 0128472 | A2 | 12/1984 |
| JP | 08203635 | | 8/1996 |
| JP | 2000-068013 | | 3/2000 |
| JP | 3102459 | U | 3/2004 |

* cited by examiner

*Primary Examiner* — Chandrika Prasad
(74) *Attorney, Agent, or Firm* — DeLio, Peterson & Curcio, LLC; Robert Curcio

(57) ABSTRACT

A plug adapter having a first plug-side end and a second plug-side end, wherein the first plug-side end is designed as a first electrical interface having a first mechanical interface geometry and at least one first inner conductor part and at least one first outer conductor part, and the second plug-side end is designed as a second electrical interface having a second mechanical interface geometry and at least one second inner conductor part and at least one second outer conductor part, wherein the first and second mechanical interface geometries have different designs. The plug adapter is designed with at least one respective first inner conductor part and one respective second inner conductor part, which are integral with one another.

17 Claims, 4 Drawing Sheets

PLUG ADAPTER HAVING PLUG SIDE ENDS WITH DISSIMILAR MECHANICAL INTERFACE GEOMETRIES

This application is a National Stage filing based on PCT/EP2010/005829, filed Sep. 23, 2010, and which claims priority to German Patent Application No. DE 20 2009 015 286.3, filed Nov. 10, 2009.

BACKGROUND OF THE INVENTION

1. Field of the Invention

The present invention relates to a plug adapter having a first plug-side end and a second plug-side end, wherein the first plug-side end is configured as a first electrical interface having a first mechanical interface geometry and at least one first inner conductor part and at least one first outer conductor part, and the second plug-side end is configured as a second electrical interface having a second mechanical interface geometry and at least one second inner conductor part and at least one second outer conductor part, wherein the first and second mechanical interface geometries have different designs.

2. Description of Related Art

It is known to arrange an HSD circuit board plug (HSD—high speed data) and a USB circuit board plug (USB—universal serial bus) on a circuit board (PCB—printed circuit board) and to connect the plugs electrically to one another via the circuit board. In this way, an adapter from an HSD interface to a USB interface is made available.

SUMMARY OF THE INVENTION

It is an object of the invention to improve a plug adapter of the aforementioned type in that a transition from one electrical interface to a geometrically differently configured interface is made available in a simple and functionally reliable manner.

This aim is achieved according to the invention by a plug adapter of the aforementioned type having the characterizing features of the claims. Advantageous embodiments of the invention are further described in the claims.

The above and other objects, which will be apparent to those skilled in the art, are achieved in the present invention which is directed to a plug adapter having a first plug-side end and a second plug-side end, wherein the first plug-side end includes a first electrical interface having a first mechanical interface geometry and at least one first inner conductor part and at least one first outer conductor part, and the second plug-side end includes a second electrical interface having a second mechanical interface geometry and at least one second inner conductor part and at least one second outer conductor part, wherein the first and second mechanical interface geometries have different designs, wherein at least one first inner conductor part and one second inner conductor part are integral with one another, the first electrical interface comprising a first outer conductor part having circular or elliptical cross-section, and the second electrical interface comprising a second outer conductor part having rectangular or polygonal in cross-section. The at least one first outer conductor part and one second outer conductor part may be integral with one another.

The first and second electrical interfaces each may comprise four inner conductor parts, each of the four first inner conductor parts of the first interface may be configured, respectively, integral with one second inner conductor part of the second interface. The first and second electrical interfaces may include an identical number of inner conductor parts.

The first electrical interface may include $N_1$ inner conductor parts where $N_1 \geq 3$ with respective first plug-side ends of the first inner conductor parts arranged in one plane at corners of an $N_1$-sided polygon. Additionally, the second electrical interface may comprise $N_2$ inner conductor parts where $N_2 \geq 3$, with respective second plug-side ends of the second inner conductor parts arranged in one plane on a straight line.

The first electrical interface may also comprise an HSD (high speed data) interface. The second electrical interface may comprise a USB (universal serial bus) interface.

At least one first inner conductor part may be configured at the plug-side end as a pin. At least one second inner conductor part may be configured at a plug-side end as a spring metal sheet part. At least one integral inner conductor part may be configured with a first inner conductor part and a second inner conductor part as a press-bent part.

The first interface may comprise a first insulating body arranged within the first outer conductor part in which the first inner conductor parts are held. The second interface may comprise a second insulating body arranged within the second outer conductor part in which the second inner conductor parts are held.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
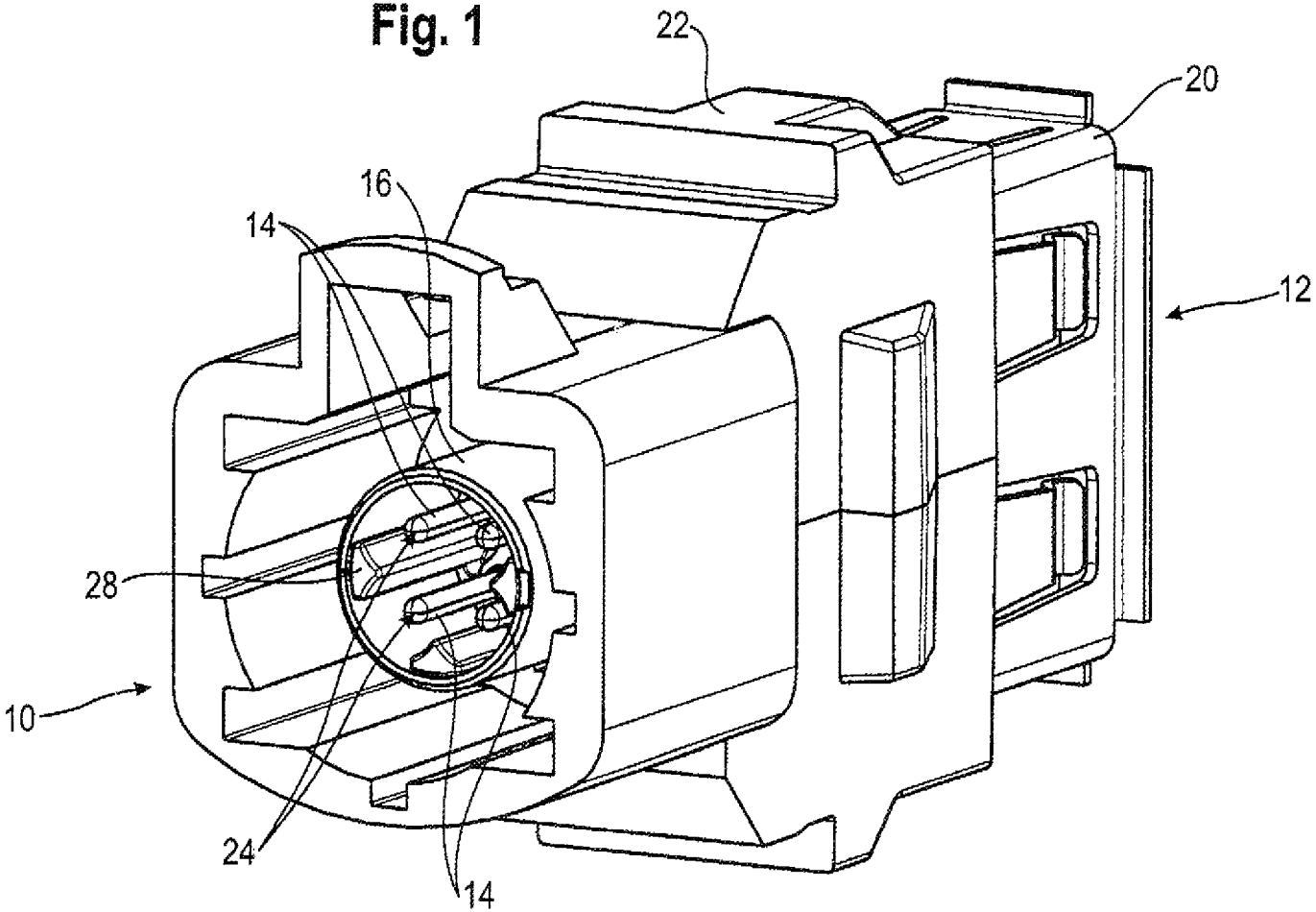
FIG. 1 shows a preferred embodiment of a plug adapter according to the invention in a perspective view of a first plug-side end having a first mechanical interface geometry.

In describing the preferred embodiment of the present invention, reference will be made herein to FIGS. 1-4 of the drawings in which like numerals refer to like features of the invention.

In a plug adapter of this type, it is provided according to the invention that, in each case, at least one first inner conductor part and one second inner conductor part are configured integral with one another.

This has the advantage that a particularly economical and simply manufactured plug adapter with improved signal transmission is provided.

A further improvement to the signal transmission by means of continuous screening of the signal conductor is achieved in that at least one first outer conductor part and one second outer conductor part are configured integral with one another.

A particularly universally usable plug adapter is achieved in that the first and second electrical interfaces each comprise four inner conductor parts, wherein each of the four first inner conductor parts of the first interface is configured, respectively, integral with one second inner conductor part of the second interface.

A particularly simple and direct signal transmission between the plug-side ends of the plug adaptor is achieved in that the first and second electrical interfaces have an identical number of inner conductor parts.

A mechanical interface geometry of the first interface which is, in cross-section, circular is achieved in that the first electrical interface comprises $N_1$ inner conductor parts where $N_1 \geq 3$, in particular $N_1=4$, with respective first plug-side ends, wherein the first plug-side ends of the first inner conductor parts are arranged in one plane at corners of an $N_1$-sided polygon.

The first electrical interface has, for example, a first outer conductor part which is configured circular or elliptical in cross-section. The first electrical interface is thus adapted to a corresponding circular or elliptical interface contour.

A mechanical interface geometry for the second interface that is essentially rectangular or polygonal in cross-section is achieved in that the second electrical interface comprises $N_2$ inner conductor parts where $N_2 \geq 3$, particularly $N_2=4$, with respective second plug-side ends, wherein the second plug-side ends of the second inner conductor parts are arranged in one plane on a straight line.

The second electrical interface has, for example, a second outer conductor part which is rectangular or polygonal in cross-section. By this means, the second electrical interface is adapted to a corresponding rectangular or polygonal interface contour.

By way of example, the first electrical interface is configured as an HSD interface (HSD—high speed data).

In a preferred embodiment, the second electrical interface is configured as a USB interface.

Simple manufacturing of an electrical plug contact at the first interface is achieved in that at least one first inner conductor part is configured at a plug-side end as a pin.

Simple manufacturing of an electrical contact at the second interface is achieved in that at least one second inner conductor part is configured at a plug-side end as a spring metal sheet part.

Particularly simple and economical production is achieved in that at least one integral inner conductor part is configured with a first inner conductor part and a second inner conductor part as a press-bent part.

For local fixing of the first inner conductor parts of the first interface to the first plug-side end of the plug adapter, the first interface comprises a first insulating body in which the first inner conductor parts are held and which is arranged within the first outer conductor part.

For local fixing of the second inner conductor parts of the second interface to the second plug-side end of the plug adapter, the second interface comprises a second insulating body in which the second inner conductor parts are held and which is arranged within the second outer conductor part.

Figure 2:
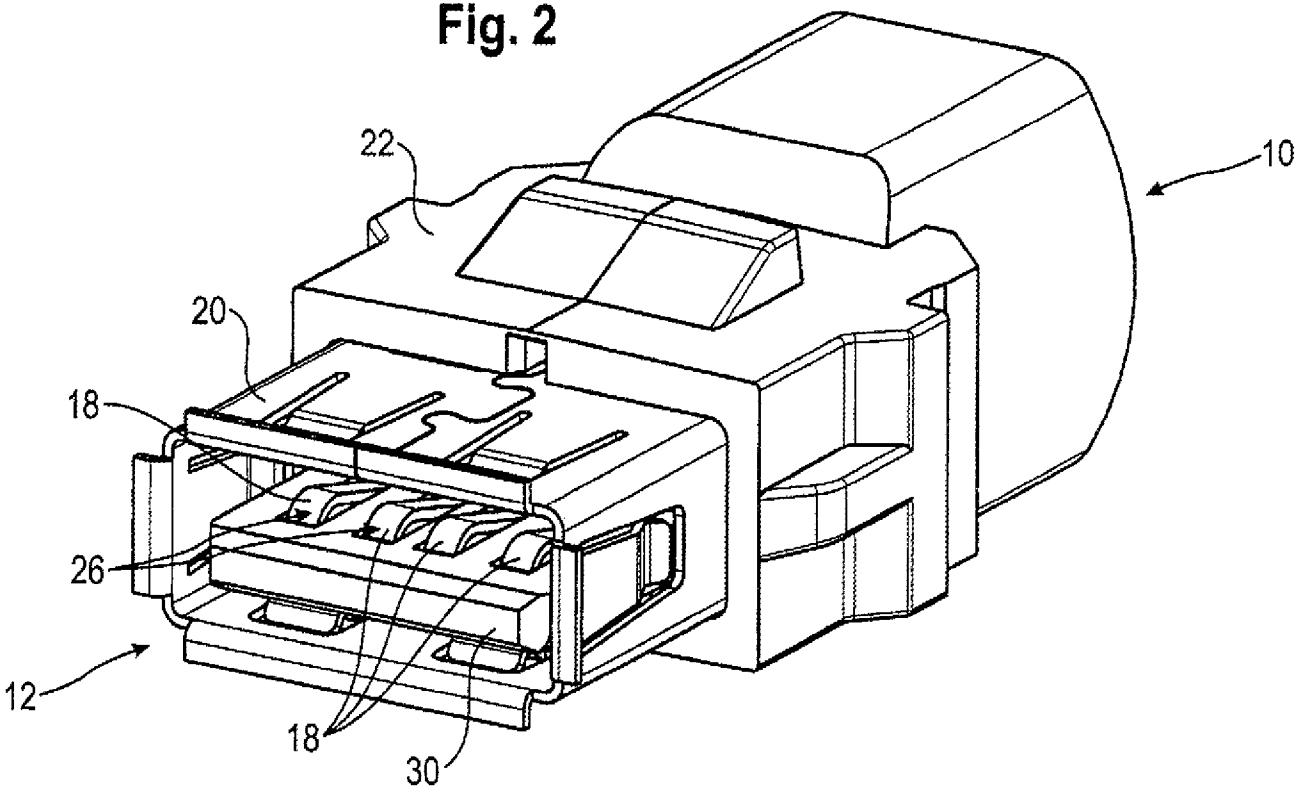
FIG. 2 shows the plug adaptor of FIG. 1 in a perspective view of a second plug-side end having a second mechanical interface geometry.
Figure 3:
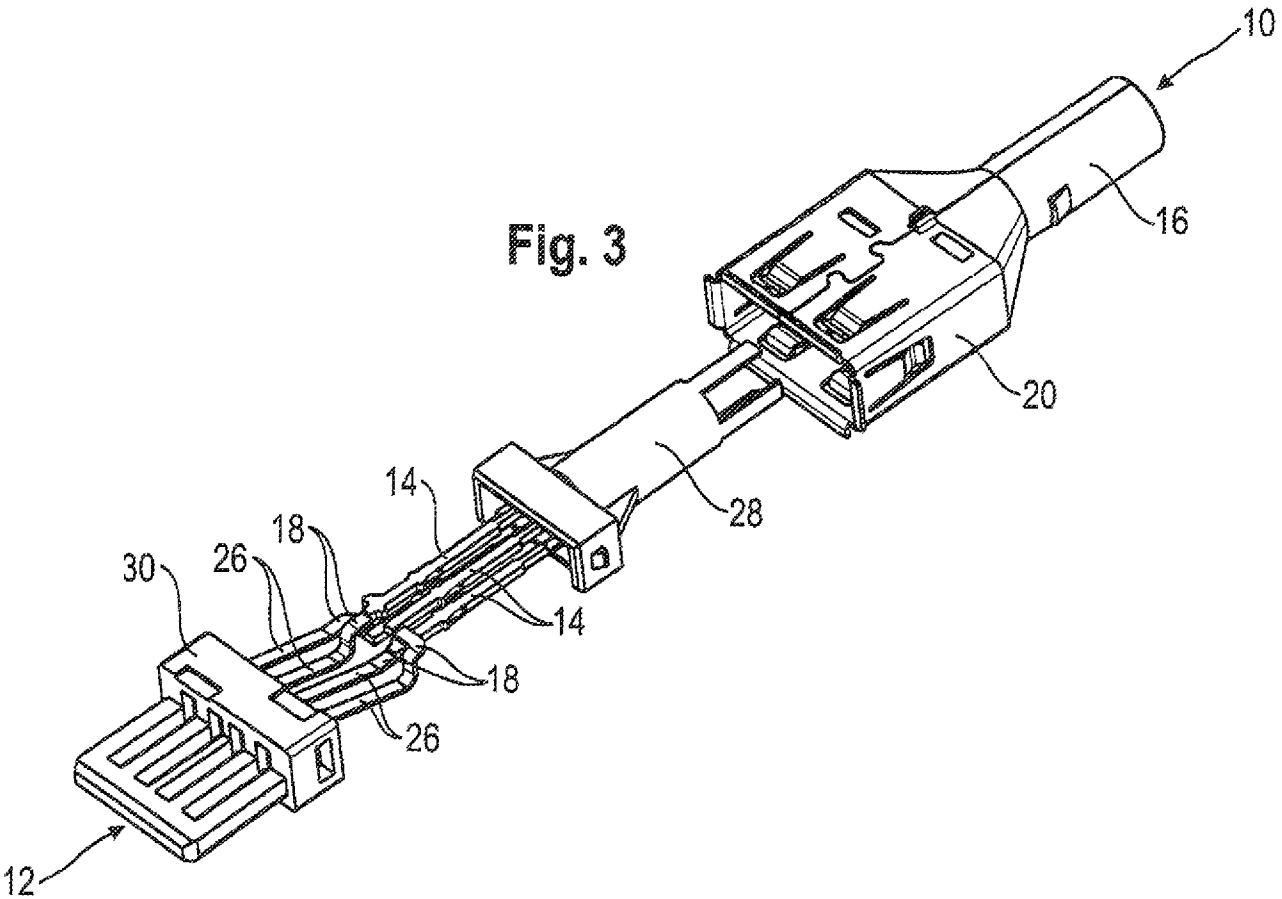
FIG. 3 shows the plug adapter of FIG. 1 in an exploded view without the housing.

The preferred embodiment of a plug adapter according to the invention shown in FIGS. 1 to 3 comprises a first plug-side end 10 and a second plug-side end 12. As shown, in particular, by FIGS. 1 and 3, the first plug-side end 10 is configured as a first electrical interface with a first mechanical interface geometry in the form of an HSD (high speed data) interface. The first electrical interface at the first plug-side end 10 thus has four inner conductor parts 14 and a first outer conductor part 16. As is clear, in particular, from FIGS. 2 and 3, the second plug-side end 12 is configured as a second electrical interface with a second mechanical interface geometry, in the form of a USB interface, differing from the first mechanical interface geometry. The second electrical interface at the second plug-side end 12 thus has four second inner conductor parts 18 and a second outer conductor part 20. The first and second outer conductor parts 16, 20 are configured integral with one another.

The preferred embodiment of the plug adapter shown in FIGS. 1 to 4 is merely exemplary and is shown, in order to simplify the description, with an HSD interface and a USB interface. The expressions "HSD interface" or "HSD plug" and "USB interface" or "USB coupler" are merely representative of every possible interface or mechanical interface geometry or plug or coupler.

Furthermore, the plug adapter according to the invention comprises a housing 22 which is configured at the first plug-side end 10 with a mechanical geometry of an HSD plug and at the second plug-side end 12 with a mechanical geometry of a USB coupler. The first inner conductor parts 14 and the first outer conductor part 16 also have, at the first plug-side end 10, the mechanical geometry of an HSD plug. Furthermore, the second inner conductor parts 18 and the second outer conductor part 20 at the second plug-side end 12 have the mechanical geometry of a USB coupler.

The first inner conductor parts 14 are configured at the plug-side ends 24 as contact pins so that said pins can be inserted mechanically into a corresponding HSD coupler (not shown) and create a corresponding electrical contact to said HSD coupler. The second inner conductor parts 18 are configured at the plug-side ends 26 as spring metal sheet parts, so that said parts can be mechanically plugged together with a corresponding USB plug (not shown) and create a corresponding electrical contact to contact surfaces in the USB plug.

The first interface at the first plug-side end 10 is configured with a first insulating part 28 which is arranged within the first outer conductor part 16 and holds the first inner conductor parts 14 fixed at predetermined positions. According to the mechanical interface geometry of the HSD interface, the first inner conductor parts 14 are arranged so as to be disposed round a circular line, wherein the first outer conductor part 16 is configured round in cross-section and surrounds the first inner conductor parts 14, which are arranged in the manner of a star-quad, as screening. At the second plug-side end 12, the second interface is configured with a second insulating part 30 which is arranged within the second outer conductor part 20 and holds the second inner conductor parts 18 fixed at predetermined positions. According to the mechanical interface geometry of the USB interface, the second inner conductor parts 18 are arranged such that the plug-side ends 26 thereof are disposed along a straight line in one plane, wherein the second outer conductor part 20 is configured rectangular in cross-section and surrounds the second inner conductor parts 18 as screening.

A first inner conductor part 14 and a second inner conductor part 18 are configured, in each case, together as an integral inner conductor part. In this way, a direct electrical connection is created between respective contacts of the two different interfaces at the respective plug-side ends 10, 12 of the plug adapter, without the need for a circuit board or other auxiliary means.

Figure 4:
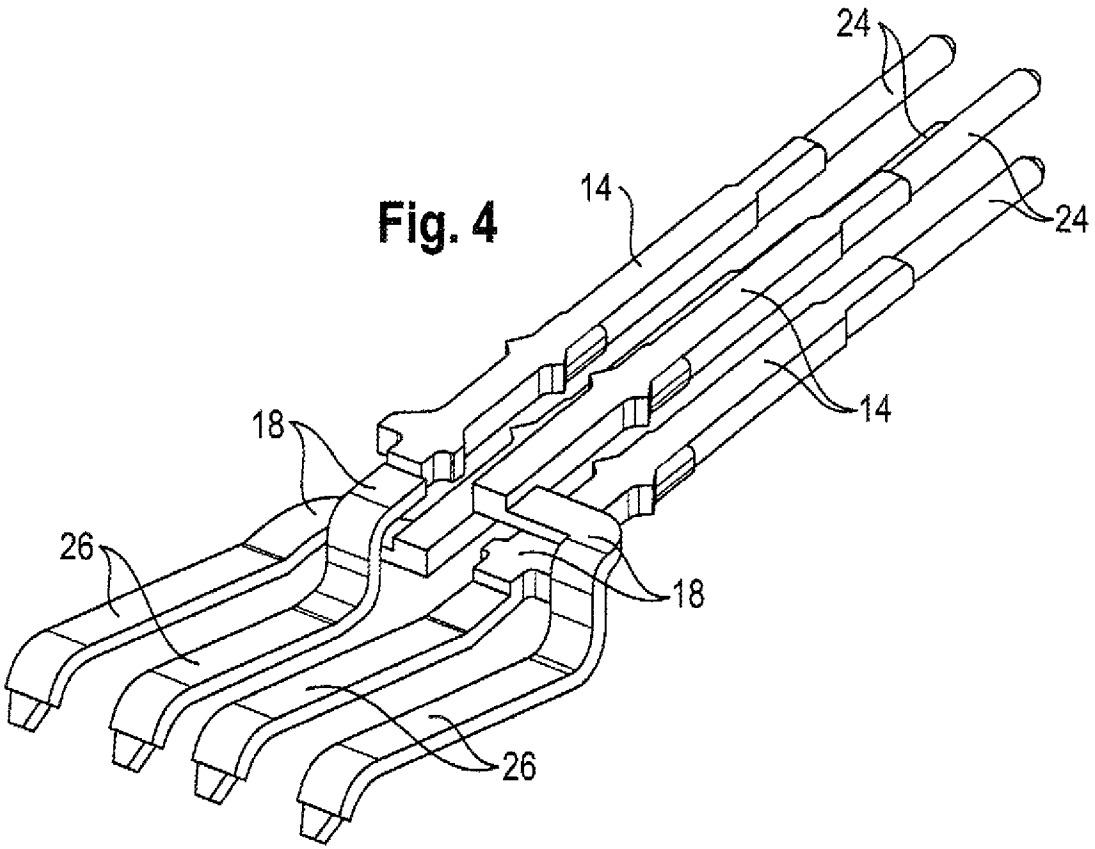
FIG. 4 shows a detailed view of an arrangement of inner conductor parts of the plug adapter of FIG. 3.

In order to be able correctly to assign the signals transmitted via the inner conductors 14, 16 to the respective contacts of the first and second interfaces, the respective integral inner conductor parts 14, 16 are configured differently in their mechanical path through the plug adapter, as FIG. 4 shows. The round geometry of the HSD interface is converted to the planar or flat geometry of the USB interface. The integral inner conductor parts 14, 16 are configured as sheet metal parts and are manufactured, for example, by means of a press-bending process with an additional stamping step.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug adapter having a first plug-side end and a second plug-side end, wherein the first plug-side end includes a first electrical interface having a first mechanical interface geometry and $N_1$ first inner conductor parts, where $N_1 \geq 3$ with respective first plug-side ends of the first inner conductor parts arranged in one plane at corners of an $N_1$-sided polygon or around a circular line, and at least one first outer conductor part, and the second plug-side end includes a second electrical interface having a second mechanical interface geometry and $N_2$ second inner conductor parts, where $N_2 \geq 3$ with respective second plug-side ends of the second inner conductor parts arranged in one plane on a straight line, and at least one second outer conductor part, wherein the first and second mechanical interface geometries have different designs, wherein at least one said first inner conductor part and at least one of said second inner conductor part are integral with one another, the first electrical interface comprising said first outer conductor part having a circular or elliptical cross-section, and the second electrical interface comprising said second outer conductor part having a rectangular or polygonal in cross-section.

2. The plug adapter of claim 1, including said at least one first outer conductor part and said one second outer conductor part being integral with one another.

3. The plug adapter of claim 1, wherein the first and second electrical interfaces each comprise four inner conductor parts, each of the four first inner conductor parts of the first interface is configured, respectively, integral with a respective second inner conductor part of the second interface.

4. The plug adapter of claim 1 wherein the first and second electrical interfaces include an identical number of inner conductor parts.

5. The plug adapter of claim 1 wherein the first electrical interface comprises an HSD (high speed data) interface.

6. The plug adapter of claim 1 wherein the second electrical interface comprises a USB (universal serial bus) interface.

7. The plug adapter of claim 1 including said $N_1$ first inner conductor parts configured respectively at the plug-side end as a pin.

8. The plug adapter of claim 1 including said $N_2$ second inner conductor parts configured respectively at a plug-side end as a spring metal sheet part.

9. The plug adapter of claim 1 including at least one integral inner conductor part configured with said $N_1$ first inner conductor parts and said $N_2$ second inner conductor parts as a press-bent part, respectively.

10. The plug adapter of claim 1 wherein the first interface comprises a first insulating body arranged within the first outer conductor part in which the first inner conductor parts are held.

11. The plug adapter of claim 1 wherein the second interface comprises a second insulating body arranged within the second outer conductor part in which the second inner conductor parts are held.

12. The plug adapter of claim 2, wherein the first and second electrical interfaces each comprise four inner conductor parts, each of the four first inner conductor parts of the first interface is configured, respectively, integral with one of said $N_2$ second inner conductor parts of the second interface.

13. The plug adapter of claim 2 wherein the first and second electrical interfaces include an identical number of inner conductor parts.

14. The plug adapter of claim 2 wherein the first electrical interface comprises an HSD (high speed data) interface.

15. The plug adapter of claim 2 including said $N_1$ first inner conductor parts configured at the plug-side end as a pin.

16. The plug adapter of claim 7 including said $N_2$ second inner conductor parts configured at said plug-side end as a spring metal sheet part.

17. The plug adapter of claim 15 including said at least one integral inner conductor part configured with said $N_1$ first inner conductor parts and said $N_2$ second inner conductor parts as a press-bent part.

* * * * *